United States Patent [19]

Beer et al.

[11] Patent Number: 4,670,114

[45] **Date of Patent: * Jun. 2, 1987**

[54] FINE, UNIFORM PARTICLES, AND PRECIPITATION OR DEPOSITING OF PARTICLES FROM A SOLUTION

[75] Inventors: Henri B. Beer, Heide-Kalmthout; Franz A. M. Van Den Keybus; Lucovicus F. M. Suykerbuyk, both of Essen, all of Belgium

[73] Assignee: Eltech Systems Corporation, Boca Raton, Fla.

[ * ] Notice: The portion of the term of this patent subsequent to Oct. 2, 2001 has been disclaimed.

[21] Appl. No.: 633,822

[22] Filed: Jul. 24, 1984

Related U.S. Application Data

[63] Continuation-in-part of Ser. No. 511,350, Jun. 13, 1983, Pat. No. 4,474,653.

[51] Int. Cl.[4] ..... C25B 1/00

[52] U.S. Cl. ..... 204/96; 204/420; 204/433; 204/1 R

[58] Field of Search ..... 204/96, 433, 1 H, 129, 204/420

[56] References Cited

U.S. PATENT DOCUMENTS

| | | | |
|---|---|---|---|
| 2,563,062 | 8/1951 | Perley | 204/195 |
| 2,607,718 | 8/1952 | Suthard | 196/41 |
| 3,214,301 | 10/1965 | Pocock et al. | 148/6.2 |
| 3,869,359 | 3/1975 | Beer | 204/96 |
| 4,152,215 | 5/1979 | Yoshino et al. | 195/127 |
| 4,474,653 | 10/1984 | Beer et al. | 204/96 |

FOREIGN PATENT DOCUMENTS

| | | | |
|---|---|---|---|
| 623339 | 7/1961 | Canada | 204/96 |
| 0026591 | 5/1980 | European Pat. Off. . | |
| 906391 | 9/1962 | United Kingdom | 204/96 |

*Primary Examiner*—R. L. Andrews
*Attorney, Agent, or Firm*—John J. Freer

[57] ABSTRACT

The precipitation or deposition of particles from a solution in a cell (61) which an electric field is applied between an anode (65,67,68) and a cathode (66), typically an electrolysis cell for the co-precipitation of mixed oxides but also cells for electrodeposition or the electrophoretic deposition of colloidal particles, is controlled by measuring the pH of the solution in the cell using a probe (72) shielded in a tube (73) from the migrating electric current and from gas bubbles. The pH of the solution is then adjusted to a selected value as a function of the measured pH, e.g. by varying the electrolysis current or by bubbling in acid vapor, air or base vapor.

18 Claims, 4 Drawing Figures

FINE, UNIFORM PARTICLES, AND PRECIPITATION OR DEPOSITING OF PARTICLES FROM A SOLUTION

This application is a Continuation-in-Part of Applicant's copending Parent Application U.S. Ser. No. 511,350 filed 6-13-83 now U.S. Pat. No. 4,474,653, the disclosure of which is herein incorporated by reference. The Parent U.S. Application Ser. No. 511,350 comes from the United States being designated under PCT/EP82/0029. The United States desination under the PCT was completed by filing a copy of the PCT Appplication in the U.S. Patent and Trademark Office on June 13, 1983. The PCT was filed Oct. 12, 1982 in the European Receiving Office deriving priority because of originating from U.K. Application 8130775 filed in the United Kingdom on Oct. 13, 1981. Thus, the present Continuation-in-Part derives priority all the way back to Oct. 13, 1981.

TECHNICAL FIELD

The invention relates to methods of controlling the precipitation or depositing of particles from a solution in a cell in which an electric field is applied between an anode and a cathode, in particular the precipitation of metal compounds such as oxides and hydroxides and the co-precipitation of mixed metal oxides from a solution of the metal salt(s) in an electrolysis cell, but also the electrolytic deposition of cathodic metal deposits as well as the electrophoretic deposition of colloidal particles, and also the invention relates to precipitated or deposited particles.

BACKGROUND ART

Methods of electrolytically co-precipitating mixed metal oxides are known from Canadian Patent No. 593 187 and U.K. Patent No. 864 249. Another method of precipitating or co-precipitating metal compounds, more particularly oxides and hydroxides, in an electrolysis cell is described in Canadian Patent No. 623 339.

It was recognized in the latter patent that the process should be carried out at a specific and as constant as possible pH, and this was achieved by carrying out a preliminary electrolysis to obtain suitable starting conditions and setting the electrolysis current at a value corresponding to the rate of supply of a solution of the salts from which the compounds are precipitated. In carrying out these known processes, it has been observed that the particle size and density do not remain constant and this reduces the usefulness of the product. The invention is based on the observation that the uneven particle size and variable density obtained with the known processes are due to variations in the solution pH which occur when following the prior teachings and because of the inherent difficulties in measuring and controlling the pH in an electrolysis cell particularly when gas is bubbled in or is electrochemically generated. Similar considerations apply to the control of the particle size and density of electrodeposited coatings and to the control of electrophoretic deposition.

DISCLOSURE OF THE INVENTION

According to the invention, the precipitation or the depositing of the particles is controlled by measuring the pH of the solution in the cell using a probe shielded from migrating electric current and adjusting the pH of the solution to a selected value as a function of the measured pH.

Preferably, this is achieved by supplying a first electrical signal representative of the measured pH, comparing the first electrical signal with a reference electrical signal corresponding to the selected pH, and adjusting the pH of the solution as a function of the difference of the first signal and the reference signal to maintain it close to the selected pH.

The pH may be adjusted by acting on any pH-determining parameter, such as by bubbling acid vapour or base vapour into the solution or by adjusting the supply of air, in case where air is supplied as an oxidant. This method of bubbling in a vapour or air is particularly appropriate when a solution of metal salt(s) to be precipitated is obtained by dissolving at least one metal anode.

In another arrangement, the pH is adjusted by varying the electrolysis current. For example a preprepared solution of metal salt(s) is introduced into a compartment of the electrolysis cell in which the particles are precipitated, and tne ions liberated oy the salt(s) are passed through a separator into another compartment of the cell by passing an electrolysis current at a rate controlled as a function of the measured pH to keep the pH of the solution at the selected value. This arrangement is recommended when it is desired to incorporate a metal such as barium which does not dissolve anodically or manganese which is soluble without the passage of current so that, when connected as as anode, it does not dissolve in proportion to the current passed. However, the arrangement can of course also be used to supply the salts of other metals.

The solution of salts can be introduced into the cell compartment by dripping it in uniformly or by blowing in a fine dispersion of the solution for example with an oxidizing gas, or in any other suitable manner.

It is possible to combine this arrangement with the previous one by providing ions of at least one further metal to be precipitated by dissolving at least one metal anode, and adjusting the pH of the solution by bubbling acid vapour, base vapour or by adjusting the supply of air into the solution when said controlled electrolysis current reaches a threshold value.

It is equally possible, when a preprepared solution of the metal salt(s) is supplied to the electrolysis cell, and whether or not this is combined with dissolving at least one metal anode, to supply a substantially constant electrolysis current calculated to correspond more or less exactly to the rate of supply of metal salt to the solution so that ions liberated by the salt(s) are passed through a separator into another compartment of the cell at a corresponding rate, and to adjust the pH to the selected value by bubbling in acid vapour, base vapour or by adjusting the supply of air as a function of the measured pH.

Advantageously, to avoid disturbance of the pH measurement in the electrolyte solution, the pH is measured by a probe disposed in a tube which shields the probe from gas bubbles and stray currents carried by migrating ions. This may be a tube which extends down to below a source of gas bubbles, or the end of the tube may be closed with an electrolyte-permeable but gas-bubble impermeable gauze. In some instances, instead of a tube, a U-shaped section or even two parallel spaced plates may be sufficient to shield the probe from the influence of stray current carried by migrating ions.

In most cases, an oxidizing gas is supplied to the electrolyte solution to precipitate an oxide or mixed oxide of the metal or metals. It is also possible to generate electrochemically an oxidizing agent in situ in the solution using an insoluble anode situated in the precipitating zone, possibly operating in conjunction with soluble anodes and preferably with an electrolyte such as sodium sulphate suitable for the generation of oxygen. Alternatively, hypochlorite can be generated as the oxidizing agent by using a sodium chloride or potassium chloride electrolyte. When an auxiliary anode is used to generate an oxidizing agent in situ, it is possible to control the pH of the electrolyte by adjusting the current supplied to the auxiliary anode as a function of the measured pH.

Thus, the invention provides for a fine, uniform powder comprising metal oxide particles wherein said particles have a particle size range of 0.009 to 0.1 micrometers. Additionaly, the invention provides for the case wherein said metal oxide particles are obtained by precipitation at controlled pH from a solution of metal salt(s), and at least 50% of the particles have a maximum particle size distribution of 0.07 micrometers within said particle size range of 0.009 to 0.1 micrometers.

BEST MODES FOR CARRYING OUT THE INVENTION

Figure 1:
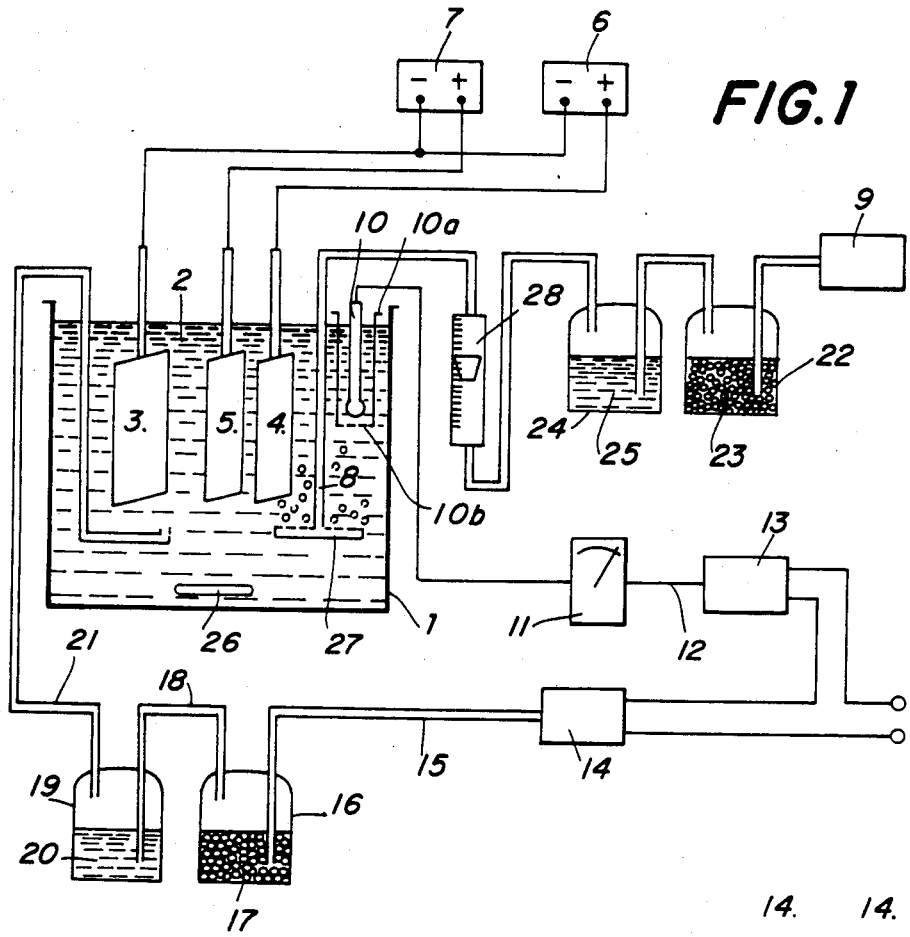
FIG. 1 is a schematic representation of an electrolysis cell and associated equipment.

As shown in FIG. 1, an electrolysis cell comprises a housing 1 containing an electrolyte 2 in which a cathode 3 and anodes 4 and 5 dip. The cathode 3 is connected to the negative terminal of two D.C. power sources 6 and 7 whose positive terminals are connected to respective anodes 4 and 5 so that these anodes can be supplied at different voltage and hence different current density. The cathode 3 may, for example, be of iron and the anodes 4, 5 of iron and nickel respectively, and the electrolyte may be an aqueous alkali metal salt solution such as KCl in which the anode metals dissolve proportionately to the respective currents that they pass. It is understood that two anodes are shown by way of example; any convenient number of anodes of different metals could be used, each supplied with current to dissolve at a desired rate, or a single anode consisting of a metal (e.g. iron) or an alloy (e.g. iron/nickel) could be used.

Under the anodes 4, 5 extends an air tube 8 through which air is delivered from an air pump 9, this air serving to oxidize the dissolved metals which are co-precipitated in the electrolyte as a mixed oxide powder, e.g. a nickel ferrite powder when iron and nickel anodes are used. Other oxidizing mediums could be used, such as oxygen, ozone, chlorine, hypochlorite, hydrogen peroxide and so on. It is also possible to generate an oxidizing agent by electrolysis.

As shown, preferably the air pump 9 is connected to the tube 8 via a jar 22 advantageously containing filter material 23, for example glass beads, a second jar 24 containing 25% KOH 25 and a flow meter 28 which is set to control the rate of supply of air by the pump 9 according to the quantity of particles to be kept in suspension in the oxidizing zone of the electrolyte 2. The KOH in jar 25 removes carbon dioxide from the air and prevents the unwanted formation of ferrous carbonate in the housing 1.

The tube 8 may simply be an open-ended tube but it is preferable in larger installations to use a distributor 27 perforated in its upper face with perforations of a selected size which produce relatively fine or large bubbles depending on the quality and dimensions of tne powder being produced.

In the bottom of the housing 1 is an optional magnetic stirrer 26, it being understood that in instances where very magnetic powders are being produced, mechanical stirring means will be preferred.

The pH of the electrolyte 2 is measured by a glass probe 10 which is inserted in the electrolyte 2 and is sheltered from the migrating electric current between the electrodes 3, 4 and from rising gas bubbles by being enclosed in a tube 10A having at its lower end a gauze 10B of suitable non-metallic material such as PTFE or PVC which is permeable to the electrolyte but not to the gas bubbles. In this manner, the probe 10 accurately measures the pH of electrolyte ascending by convection in the tube without disturbance from air bubbles or stray current carried by migrating ions. This probe 10 is connected to a pH meter, which provide a visual display of the measured pH and an analog electric output signal 12 corresponding to the measured pH. The signal 12 is delivered to a control circuit 13, described in detail later, which compares the signal 12 with a reference signal corresponding to a selected pH, and switches on or off an air pump 14.

When actuated, the air pump 14 blows air through a tube 15 which extends into a jar 16 containing filter material 17, for example glass beads, into which the tube 15 dips. This filter material 17 prevents acid fumes from penetrating into the air pump 14. The top part of filter jar 16 is connected by a tube 18 to another jar 19 containing concentrated hydrochloric acid 20, into which the tube 18 dips. Finally, a tube 21 extends from the space in jar 19 above the hydrochloric acid 20 to the electrolyte 2 in vessel 1, the tube 21 terminating just below the space between cathode 3 and anodes 4, 5. If desired, this tube 21 may be fitted with a perforated distributor like distributor 27.

Thus, when the air pump 14 is switched on, the air blown along tubes 15 and 18 drives air containing acid vapour along the tube 21 and this acidified air is delivered into the electrolyte 2 and bubbles up through the zone where the co-precipitation of the metal oxides is taking place. The air delivered by tube 21 thus acts in the same way as the air delivered by tube 8 to oxidize the metal ions. The minute particles of acid delivered are very evenly distributed by the bubbling air in the co-precipitation zone of the electrolyte 2 and/or on the co-precipitated particles, and this ensures a very homogeneous distribution of the acid in the co-precipitaitation zone. This supply of acidified air continues until the pH has dropped to the pre-selected value, corresponding to a desired particle size.

Figure 2:
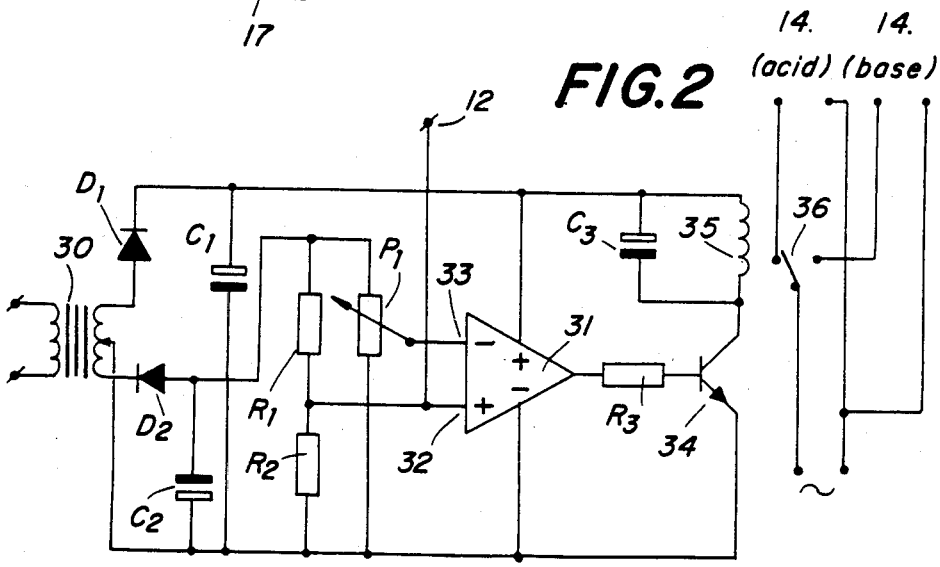
FIG. 2 is a circuit diagram of a control unit.

With reference to FIG. 2, the pH control circuit 13 is connected to the A.C. mains by a transformer 30 which provides, by means of diodes D1 and D2 and capacitors C1 and C2, a stable D.C. input powering an operational amplifier 31. The output signal 12 of pH meter 11 is connected to a resistance bridge formed by resistors R1 and R2 and to one input, 32, of the operational amplifier 31. The input signal on 32 is thus a voltage which fluctuates in proportion to the measured pH. The other input 33 of amplifier 31 is connected to a potentiostat P1 which provides an input signal on 33 of constant voltage, but which can be set at any value corresponding to a selected pH according to the desired particle size and density.

It can readily be seen that by setting the potentiostat P1 appropriately in relation to the values of resistors R1 and R2, the signal on 33 can, if desired, be set equal to the signal on 32 and in fact that is what is usually done at the beginning of operation: the pH of the electrolyte 2 is brought to a selected value according to the desired particle size, and the potentiostat P1 is set to a corresponding pH value.

Via a resistor R3, a transistor 34 and a relay 35 stabilized by a capacitor C3, operational amplifier 31 controls a switch 36 controlling the air pump 14. As shown, the switch 36 controls two circuits for actuating the pump: one circuit for use when the pump 14 actuates the supply of acid or air, the other circuit for use when the pump 14 actuates the supply of a base. In the instance described with reference to FIG. 1 where there is acid 20 in the jar 19, the circuit corresponding to the supply of acid is used. In this case, as long as the signal on 32 does not exceed the reference signal on 33, the amplifier output is zero, switch 36 remains open and the air pump 14 is off. However, when the pH of the electrolyte 2 rises so that the signal on 32 exceeds the reference signal on 33, this triggers the amplifier 31 and the switch 36 is closed (as shown) by energisation of the coil of relay 35. As soon as the pH of the electrolyte 2 is brought back to the reference value by the supply of acidic air, the amplifier output drops to zero and the switch 36 springs open.

With the described pH measuring and control system, the pH can be controlled very accurately, to about $+/-0.05$, and because the pH of the precipitation zone can be maintained homogeneous at a chosen pH, particles of a specified uniform size and density can be obtained.

Figure 3:
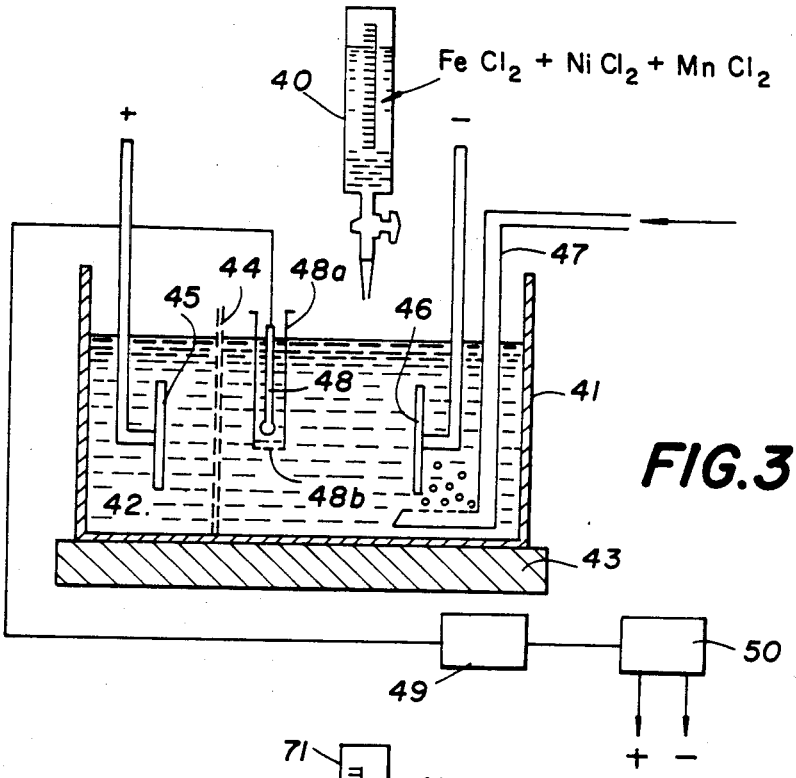
FIGS. 3 and 4 are schematic representations of further arrangements.

FIG. 3 shows an arrangement in which a solution of salts for conversion to a mixed oxide is dripped into an electrolysis cell from a burette 40. The cell has a housing 41 containing an electrolyte 42 such as KCl or NaCl. The cell housing 41 is placed on a heater 43. Cell housing 41 is divided by a diaphragm or membrane 44 into an anode compartment containing an anode 45 and a cathode compartment containing a cathode 46. The anode 45 is preferably a dimensionally-stable anode consisting for example of a sheet of expanded titanium mesh coated with an electrocatalytic coating such as a so-called "mixed crystal" of ruthenium oxide-titanium oxide. The cathode 46 may consist of iron, nickel or stainless steel. The diaphragm of membrane 44 is of the anion-exchange type, i.e. in the case where a mixture of chlorides is supplied by the burette 40 it will allow chloride ions to migrate from the cathode compartment into the anode compartment.

Into the cathode compartment extends a tube 47 through which air can be supplied in the vicinity of cathode 46.

The arrangement so far described corresponds substantially to the prior-art arrangement of Canadian Patent No. 623.339. According to the practice of the prior art, current was passed between the anode 45 and cathode 46 to bring the pH in the anode and cathode compartments to desired values. Then a solution of metals to be precipitated, for example, a mixture of $FeCl_2$, $NiCl_2$ and $MnCl_2$ in a desired ratio, is introduced into the cathode compartment from the burette 40, and the current and the rate of supply of the solution were set so that the concentration of precipitating ions in the cathode compartment remained substantially constant. Thus chloride ions from the supplied chloride solution migrate through the diaphragm or membrane 44 and are released as chlorine gas at the anode 42. In the cathode compartment, the dissociated iron, nickel and manganese ions are oxidized by the air supplied through tube 47 and are precipitated as a mixed oxide. The starting-up of this process is complicated, and any fluctuations in the current supplied or the rate of supply of the solution can upset the equilibrium of the process so that very careful monitoring is required.

According to the invention, the arrangement is provided with a pH probe 48 dipping into the cathode compartment and shielded in a tube 48A with an electrolyte-permeable but gas-permeable PTFE or PVC gauze 48B. This tube protects the probe from the effect of stray current carried by migrating ions and from the ascending gas bubbles, so that the pH measurement is not disturbed. The probe 48 supplies an analog signal proportional to the measured pH to a pH control circuit 49 which compares this signal with a pre-set control value corresponding to a desired pH. The circuit 49 in turn supplies an analog output signal to a DC source 50. This DC source is connected to the anode 45 and cathode 46 so that the electrolysis current supplied is exactly that which required to maintain a constant pH in the cathode compartment, whatever may be the fluctuations in the rate of supply of the mixed chloride solution from burette 40. Start-up of the co-precipitation process is thus greatly facilitated and optimum conditions for co-precipitation at an exactly set pH can be maintained easily.

Figure 4:
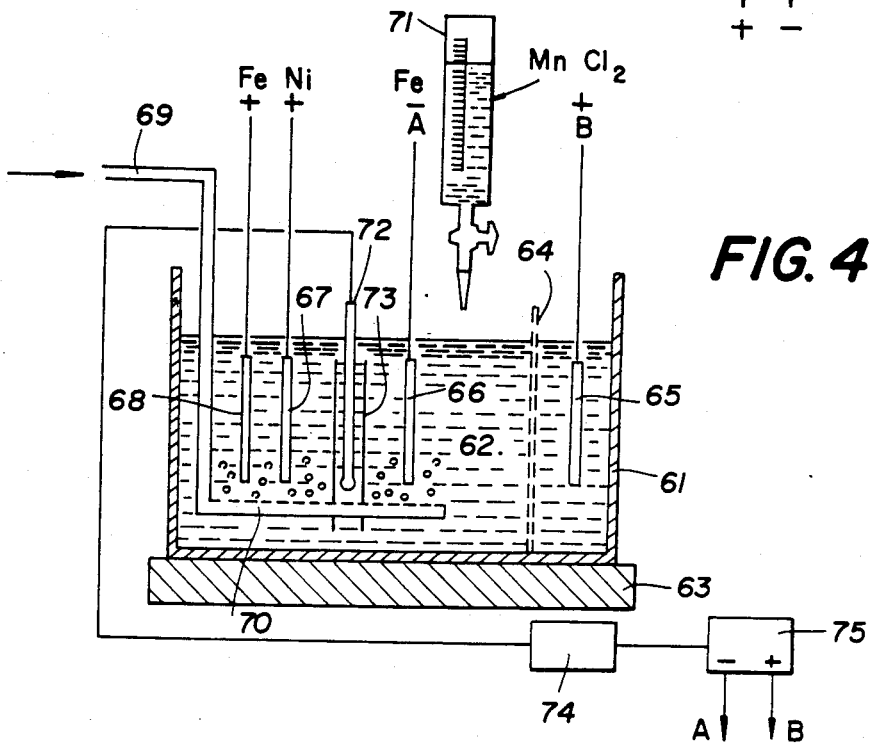

FIG. 4 shows a hybrid arrangement which produces mixed oxides by the combined action of dissolving one or more soluble anodes (as in FIG. 1) and supplying a solution of at least one metal salt (as in FIG. 3). The cell of FIG. 4 has a housing 61 containing an electrolyte 62 such as KCl or NaCl, the housing 61 being placed on a heater 63. The cell housing 61 is divided oy an anion-exchange diaphragm or membrane 64 into a first compartment containing a dimensionally-stable anode 65 and a second compartment containing a cathode 66, for example of iron, and two auxiliary soluble anodes 67 and 68, for example of nickel and iron. Into this second compartment extends a tube 69 through which air or an air/ammonia mixture is supplied and bubbled under the cathode 66 and anodes 67, 68 through a perforated distributor 70. Above the second compartment is a burette 71 from which a solution of one or more salts, for example a solution of manganese chloride, can be supplied adjacent to the cathode 66. In the zone of electrolyte 62 between or adjacent to the cathode 64 and soluble anodes 67, 68 dips a glass pH probe 72 enclosed in an open-ended glass tube 73 which extends to below the distributor 70. This tube 73 protects the pH probe 72 from the effect of stray current carried by ions migrating between the cathode 66 and anodes 67, 68 and from the effect of ascending gas bubbles. The probe 72 thus accurately measures the pH of electrolyte ascending by convection in the tube 73.

The probe 72 supplies an analog signal proportional to the measured pH to a control circuit 74 which compares this signal with a pre-set control value corresponding to a desired pH. The circuit 74 in turn supplies an analog output signal to a DC source 75 connected to the anode 65 and cathode 66 so that the electrolysis current supplied is exactly that which is required to maintain a constant pH in the second compartment.

As in the arrangement of FIG. 1, the anodes 67, 68 are connected to separate DC supply sources with a common cathodic connection with source 75 and cathode 66, so that the anodes 67, 68 can be supplied at different current densities and dissolve proportionately to the different currents that they pass. The rate of supply of $MnCl_2$ solution from burette 71 is correlated to the current supplied to anodes 67, 68 and hence their rates of dissolution so that a mixed oxide (manganese-nickel ferrite) of desired composition is obtained. In normal operation, carbon dioxide-free air is supplied via tube 69 to ensure oxidation of the dissolved metals. However, as a modification of the process, it is also possible to intermittently supply an air/ammonia mixture as an additional means of keeping the pH in the second compartment constant. This can be achieved using the circuitry of FIG. 2 with the switch 36 controlling the circuit for the supply of a base (ammonia). Or the pH control circuit could be arranged so that when the analog signal of circuit 74 (and hence the current between anode 65 and cathode 66) reaches a threshold value, the supply of air/ammonia is actuated.

EXAMPLE I

The arrangement of FIGS. 1 and 2 was used for the production of a nickel ferrite using nickel and iron anodes, the anode currents being arranged to dissolve the metals to give a theoretical composition of equimolar $Fe_2O_3/NiO$. The electrolyte was 5% KCl at 70° C. The electrolysis was carried out both with control of the pH between 6.2 and 6.4 by the intermittent supply of acid air using the described pH measurement and control device and, for comparison, using the prior art method without servo-control of the pH in the cell. The powders obtained were dried and examined by transmission electron microscopy. The measured particle size ranges of greater than 50% of the particles (PSR 50) and the total particle size ranges (TPSR) are shown in Table I.

TABLE I

| | | PSR 50 Micron | TPSR Micron |
|---|---|---|---|
| controlled | particles | 0.009–0.02 | 0.005–0.08 |
| pH | flakes | | 0.02–0.13 |
| prior art | particles | 0.12–0.24 | 0.03–0.40 |
| | flakes | | 0.04–.80 |

It can readily be seen from this table that the particles/flakes produced are considerably finer and more uniform when the pH is controlled according to the invention.

It was further observed that when the pH control device was used, the intermittent supply of HCl vapour continued throughout the process with variable intervals.

Also, the pH range of 6.2–6.4 was chosen as this is found to give the most dense nickel ferrite. When a less dense product is required, the pH is set at a selected higher value.

EXAMPLE II

The arrangement of FIGS. 1 and 2 was used for the production of iron oxide (ferrite) using a single soluble iron anode in a 5% KCl electrolyte. The pH was controlled at 6.2–6.4. The process parameters were varied by using the electrolyte at 70° C. or 90° C. and by blowing in very fine air bubbles or larger air bubbles, or with in situ oxidation using an auxiliary dimensionally stable electrode.

In all instances, it was found that the pH control circuit operated to intermittently supply HCl vapour at varying intervals during a start-up phase of about 30 minutes to 1 hour and thereafter the process reached a steady state at constant pH with little or no further additions of HCl vapour.

Also, in all instances, a fine uniform powder was obtained. Typical size ranges measured by transmission electron microscopy are: PSR 50: 0.03–0.1 micron, TPSR: 0.03–0.5 micron. Furthermore, the particles were analysed for their contamination with potassium. The average potassium content was 45 ppm with a maximum of 59 ppm and a minimum of less than 5 ppm.

When it was attempted to carry out the same process with the pH control device switched off, it was found that the pH progressively rose from 6 to about 9 and instead of fine particles a sludge was produced. Analysis of the product showed a potassium contamination of the order of 1900–2000 ppm.

Also, when the process was carried out at about 75° C. or below, it was found that the pH control could be achieved by blowing in an extra controlled amount of air (freed from $CO_2$ by passing through KOH) without acid vapour. At higher temperatures the acid vapour is needed to compensate for evaporation of acid fumes from the cell.

INDUSTRIAL APPLICABILITY

The particles obtained by precipitating at controlled pH according to the invention will often be oxides which, on account of their uniformity and extremely fine size, are useful in many applications especially as permanent magnets and in electronics applications for ferrite-based materials.

One particular application for the fine and uniform particles obtained according to the invention is in the manufacture of electrodes for electrolytic processes, such as the ferrite-based electrodes for molten salt electrolysis disclosed in PCT publication WO 31/01717. In manufacturing such electrodes, the particles obtained according to the invention are usually cold presses isotatically then sintered at an elevated temperature (about 1350° C.) under argon or with a low oxygen pressure. The uniformity and fineness of the particles considerably simplifies the sintering operation and gives very high density electrode bodies (more than 90% of the theoretical density). The particles can be sintered alone or in admixture with particles of other materials. Electrodes produced using the fine and uniform powders obtained according to the invention have enhanced stability because of the homogeneity of the particles.

Another application of the invention is in the production of fine metal powders by precipitating particles of the oxides (or hydroxides) and subjecting then to reduction to give a very fine and homogenous powder of the metal(s). This is for instance useful in producing very fine iron particles which would be pressed into a body for use as an electrode in batteries such as the iron-air or iron-nickel battery.

It will be appreciated that the described embodiments of pH control for the precipitation of particles in an electrolysis cell apply also to electrodeposition cells particularly where it is desired to obtain cathodic deposits of desired uniform grain size, crystal structure and porosity all of which may be adversely affected by small fluctuations in the pH adjacent the depositing zone. Using the described pH control devices, where the pH is measured in or very close to the depositing zone, uniform cathodic deposits can be grown to the desired thickness with great simplification of the process control. Likewise, the electrophoretic deposition of charge colloidal particles is pH dependent and small fluctuations of the pH affect the rate of deposition and the deposit quality and uniformity. By controlling the deposition as a function of the pH measured in or close to the depositing zone according to the invention, the deposit quality can be improved and the process control simplified.

What we claim is:

1. Particles obtained by precipitation from a solution of metal salts in a cell in which an electric field is applied between an anode and a cathode, and wherein there are gas bubbles in the solution and the precipitation is controlled by measuring inside of the cell the pH of the solution in the cell using a probe situated inside of the cell, said probe being shielded from migrating electric current and from gas bubbles, and by adjusting the pH of the solution to a selected value as a function of the measured pH, whereby said particles are produced.

2. The particles of claim 1, obtained by controlled precipitation wherein a first electrical signal representative of the mesured pH is supplied, the first electrical signal is compared with a reference electrical signal corresponding to the selected pH, and the pH of the solution is adjusted as a function of the difference of the first signal and the reference signal to maintain it close to the selected pH.

3. The particles of claim 1, wherein the pH of the solution in which the particles were produced was adjusted by bubbling acid vapour, air or base vapour into the solution as a function of the measured pH.

4. The particles of claim 1 or 3, wherein said particles constitute a fine, uniform powder of metal oxide particles having a particle size range of 0.009 to 0.1 micrometers.

5. The particles of claim 4, wherein at least 50% of the particles have a maximum particle size distribution of 0.07 micrometers within said particle size range of 0.009 to 0.1 micrometers.

6. The particles of claim 1, 2 or 3, in the form of metal compounds precipitated from a solution of metal salts obtained by dissolving at least one metal anode.

7. The particles of claim 1, in the form of metal compounds precipitated from a preprepared solution of metal salts introduced into a compartment of the cell in which the particles are precipitated, and wherein nonmetallic ions liberated by the salts are passed through a separator into another compartment of the cell by passing an electrolysis current at a rate controlled as a function of the measured pH to keep the pH of the solution at the selected value.

8. The particles of claim 7, which additionally contain at least one further metal and are obtained by a method wherein ions of said at least one further metal are obtained by dissolving at least one metal anode and are coprecipitated with metals from the preprepared solution of metal salts, and the pH of the solution is adjusted by bubbling acid vapour, air or base vapour into the solution when said controlled electrolysis current reaches a threshold value.

9. The particles of claim 1, 2 or 3, wherein the pH measurement probe is disposed inside of a tube which shields the probe used for controlling precipitation of the particles from the migrating current and from the gas bubbles.

10. The particles of claim 9, which are metal oxide particles obtained by supplying an oxidizing gas to the solution to precipitate oxide(s) of metal salts dissolved in the solution.

11. The particles of claim 1 or 2, which are precipitated by an oxidizing agent generated in situ in the solution by an insoluble anode.

12. The particles of claim 11, obtained by supplying current to said insoluble anode controlled as a function of the measured pH.

13. Particles obtained by precipitation from a solution in a cell in which an electric field is applied between an anode and a cathode, and wherein oxidizing gas is supplied to the solution to precipitate oxide(s) of metal salts dissolved in the solution, said precipitation comprising controlling the pH and thereby controlling the precipitation of the particles by measuring inside of the cell the pH of the solution in the cell using a probe situated inside of the cell, said probe being disposed inside of a tube which shields the probe from migrating electric current and from gas bubbles, and by adjusting the pH of the solution to a selected value by bubbling acid vapour, air or base vapour into the solution as a function of the measured pH, whereby said particles are produced.

14. The particles of claim 13, produced by continuously supplying the oxidizing gas and intermittently supplying the acid vapour, air or base vapour as a function of the measured pH.

15. Particles obtained by precipitation from a solution in a cell in which an electric field is applied between an anode and cathode, and wherein a prepared solution of metal salts is introduced into a first compartment of the cell and oxidizing gas is supplied to the solution to precipitate oxide(s) of the metal salts, and ions liberated by the salts are passed through a separator into another compartment of the cell by passing electrolysis current, precipitation of the particles being controlled by measuring inside of said first compartment of the cell the pH of the solution in said first compartment using a probe situated therein, said probe being disposed inside of a tube which shields said probe from migrating electric current and from gas bubbles, and by adjusting the pH of the solution to a selected value by passing said electrolysis current as a funciton of the measured pH to keep the pH of the solution at the selected value, whereby said particles are produced.

16. The particles of claim 13, 14, or 15, wherein said particles constitute a fine, uniform powder of metal oxide particles having a particle size range of 0.009 to 0.1 micrometers.

17. The powder of claim 16, wherein at least 50% of the particles have a maximum particle size distrIbution of 0.07 micrometers within said particle size range of 0.009 to 0.1 micrometers.

18. Particles of metal oxide obtained by precipitation at controllled pH from a solution of metal salt(s) wherein said particles constitute a fine uniform powder having a particle size range from 0.009 to 0.1 micrometer and a maximum particle size distribution of 0.07 micrometer within the particle size range of 0.009 to 0.1 micrometer, said particles being precipitated from a solution of metal salts in a cell in which an electric field is applied between an anode and a cathode and in which an oxidizing gas is supplied to precipitate particles of the metal oxide and wherein precipitation of the particles is controlled by measuring the pH of the solution inside the cell and adjusting the pH of the solution in the cell to a selected value by bubbling acid vapour, air or base vapour into the solution as a function of the measured pH.

* * * * *